US007870756B2

(12) United States Patent
Görz et al.

(10) Patent No.: US 7,870,756 B2
(45) Date of Patent: Jan. 18, 2011

(54) REFRIGERATOR FEATURING RECIRCULATED AIR COOLING

(75) Inventors: Alexander Görz, Aalen (DE); Hans Ihle, Giengen (DE); Ralf Spiller, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 249 days.

(21) Appl. No.: 11/918,594

(22) PCT Filed: Apr. 18, 2006

(86) PCT No.: PCT/EP2006/061637

§ 371 (c)(1),
(2), (4) Date: Oct. 15, 2007

(87) PCT Pub. No.: WO2006/120110

PCT Pub. Date: Nov. 16, 2006

(65) Prior Publication Data

US 2009/0038336 A1 Feb. 12, 2009

(30) Foreign Application Priority Data

May 10, 2005 (DE) ..... 10 2005 021 557

(51) Int. Cl.
*F25D 17/04* (2006.01)

(52) U.S. Cl. ..... 62/417; 62/407; 62/408; 62/440; 62/441; 62/447

(58) Field of Classification Search ..... 62/407, 62/408, 417, 440, 441
See application file for complete search history.

(56) References Cited

U.S. PATENT DOCUMENTS

| | | | | | |
|---|---|---|---|---|---|
| 3,283,528 | A | * | 11/1966 | Palm et al. | 62/187 |
| 4,122,687 | A | * | 10/1978 | McKee | 62/156 |
| 5,315,846 | A | * | 5/1994 | Lee | 62/419 |
| 5,375,428 | A | * | 12/1994 | LeClear et al. | 62/187 |
| 5,704,224 | A | | 1/1998 | Choi | |
| 5,943,870 | A | | 8/1999 | Lee | |

(Continued)

FOREIGN PATENT DOCUMENTS

DE 24 53 796 5/1976

(Continued)

OTHER PUBLICATIONS

International Search Report PCT/EP2006/061637.

*Primary Examiner*—Cheryl J Tyler
*Assistant Examiner*—Justin Loffredo
(74) *Attorney, Agent, or Firm*—James E. Howard; Andre Pallapies

(57) ABSTRACT

A refrigerator includes an evaporator zone and a cooling zone separated from each other in a refrigerator housing. A fan drives a cold air flow from the evaporator zone into the cooling zone via a central inlet port that is arranged next to a heat-insulating partition located between the evaporator zone and the cooling zone. A distributing device that diverts a partial air flow into a distributor pipe that extends along a wall of the cooling zone is mounted upstream of the central inlet port in the direction of flow of the cold air. The distributor pipe is provided with holes that are distributed along the height of the wall and extend into the cooling zone.

20 Claims, 4 Drawing Sheets

U.S. PATENT DOCUMENTS

Figure 1:
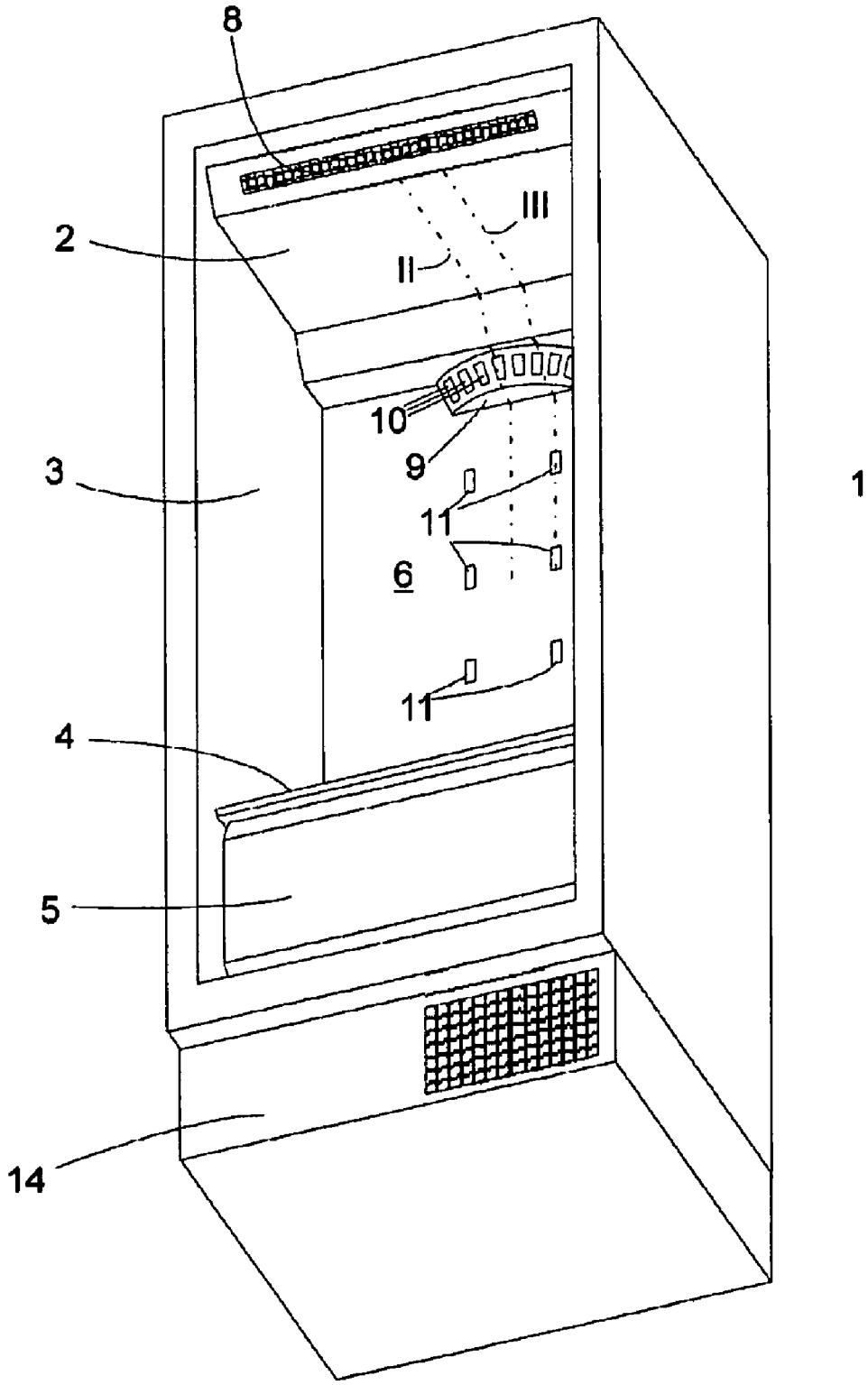

| | | | | |
|---|---|---|---|---|
| 2002/0059805 | A1* | 5/2002 | Lee et al. | 62/407 |
| 2004/0139763 | A1* | 7/2004 | Jeong et al. | 62/448 |
| 2004/0255607 | A1* | 12/2004 | Barmann et al. | 62/407 |
| 2005/0138952 | A1* | 6/2005 | Jeong et al. | 62/407 |

FOREIGN PATENT DOCUMENTS

| | | |
|---|---|---|
| JP | 7-83553 | 3/1995 |
| JP | 2000-205737 | 7/2000 |

* cited by examiner

REFRIGERATOR FEATURING RECIRCULATED AIR COOLING

The present invention relates to a refrigerator featuring recirculated air cooling, i.e. a refrigerator in whose housing an evaporator zone and a cooling zone for receiving goods to be cooled are separated from each other and the cooling zone is cooled by cold air supplied from the evaporator zone.

The cold air can be supplied to the cooling zone via what is known as an air shower or a distributor channel. In the simplest case the air shower is an opening in a partition between evaporator zone and cooling zone through which the entire cold air flow is supplied to the cooling zone. Since the cooling zone is usually divided by carriers for goods to be cooled into a plurality of compartments, the problem results of the cold air flow spilling completely into one of the compartments which is consequently cooled significantly more than other compartments that are further away from the air shower and are screened by the carriers for goods to be cooled. If the temperature in the cooling zone is regulated by a thermostat with the aid of a temperature sensor arranged in a remote compartment, the problem can occur that the compartment located immediately next to the air shower is cooled more than is beneficial to the contents thereof, in particular if heavy loading hinders air circulation in the cooling zone. If, on the other hand a temperature sensor is used in the compartment located immediately next to the air shower, compartments that are further away may be inadequately cooled.

To counter this problem refrigerators with distributor channels have been developed, i.e. with channels fed with cold air from the evaporator zone and which run along a wall of the cooling zone and are provided with openings through which cold air can flow directly into each compartment of the cooling zone. By suitably dimensioning the cross-sections of channels and openings variable cold air flow rates may to a large extent be achieved for individual compartments, so a desired temperature distribution can be achieved in the compartments irrespective of the degree of loading. The flow speed of the cold air in a distributor channel of this kind must not be too large as otherwise a powerful fan is required to drive it and a fan of this kind, of which the waste heat has to be removed from the appliance, affects the energy efficiency thereof. High flow speeds also lead to undesirable operating noises. However, a high channel cross-section leads to undesirable losses either in cooling space or insulating strength. To achieve adequate cooling with a low air throughput the cold air supplied to the cooling zone has to be colder than in an appliance with an air shower which is not subject to these limitations. If however this leads to excessively cold air being supplied to a cooling zone with a desired temperature above 0° C., damage can occur to the goods to be cooled.

There are recirculated air-cooled refrigerators with two cooling zones that are separate from each other and are to be kept at different temperatures. To regulate the temperature in the two zones independently of each other, it is necessary to be able to meter the cold air flow to the two zones independently of each other. This can take place with the aid of a valve which, depending on the position, conveys the cold air flow from the evaporator zone to the first or second cooling zone. Using a valve of this kind it is possible to optionally feed a cold air supply opening or a cold air supply pipe, leading into a first cooling zone, which leads along a wall of the first cooling zone to the second cooling zone. On the other hand it is a problem to supply cold air optionally to the cold air supply pipe or a distributor pipe, likewise running along the wall, for the first cooling zone. The reason for this lies in the cross-sections of the pipes. These should not project, or at best project only slightly, beyond the wall into the first cooling zone since this makes use thereof difficult. They must not penetrate too deeply into the wall either since there is then only a thin insulating layer between the pipes and the outer skin of the appliance. This means that the cross-section of the pipes has be much smaller in the thickness direction of the wall than transversely thereto, with the consequence that a valve, which is capable of switching over between distributor pipe of the first cooling zone and distributor pipe of the second cooling zone, has be to very large and bulky and can scarcely be accommodated without sensitive losses in the useful volume of the cooling zones.

The object of the present invention is to provide a refrigerator featuring recirculated air cooling which allows uniform, or to a desired extent, non-uniform, temperature distribution in a cooling zone and in the process avoids the problems illustrated above of refrigerators with distributor channels.

The object is achieved by a refrigerator comprising a housing in which an evaporator zone and at least one cooling zone are separated from each other, and a fan for driving a cold air flow from the evaporator zone into the cooling zone via a central inlet port adjacent to a heat-insulating partition between evaporator zone and cooling zone, in which a distributing device, which diverts a partial air flow into at least one distributor pipe running along at least one wall of the cooling zone, is arranged upstream of the central inlet port in the direction of flow of the cold air, the distributor pipe comprising openings that are distributed over the height of the wall and end in the cooling zone.

This construction divides the remaining portion of the cold air flow supplied to the cooling zone. A portion of the cold air flow is supplied via the central inlet port via the openings in the distributor pipe. Said division of the cold air flow generates an evened-out temperature distribution within the cooling zone. Depending on the construction of the distributing device, cold air flows may achieve equal or unequal volume flow rates, wherein the predominant portion of the cold air flow should advantageously exit via the central inlet port.

The distributing device can be formed by a hood which covers a cold air supply opening formed in the partition and at least one of the openings in the distributor pipe. The distributing device can also be formed by an adjustable reversing flap.

The hood forms a flow resistance for air that has passed through the cold aid supply opening and at least partially forces this through the opening it covers and into the distributor pipe. The cold air is distributed among various locations of the first cooling zone via the openings of the distributor pipe not covered by the hood.

The central inlet port is preferably formed directly on the hood.

A preferred field of application of the invention are refrigerators with two cooling zones. If in a refrigerator of this kind the second cooling zone is cooled via a cold air supply pipe running in a wall of the housing from the evaporator zone along the first cooling zone to the second cooling zone, the space in or on the housing wall for a distributor pipe for distributing the cold air is particularly tight in the first cooling zone.

In a refrigerator of this kind a deflecting means, for example in the form of a valve or a reversing flap or the like, can preferably be switched over between a position in which it blocks the cold air supply to the distributing device and clears the cold air supply pipe, and a position in which it clears the cold air supply to the distributing device and blocks the cold air supply pipe, to regulate the temperatures of the two cooling zones independently of each other.

To drive the cold air into the distributor pipe with low flow resistance, the pipe is preferably arranged substantially parallel to the flow direction of the cold air through the cold air supply opening, whereas the flow direction of the cold air through the air passage opening differs from that through the through-opening. Since the cold air supply opening is adjacent to the wall in which the distributor pipe runs, only a slight deflection of the air flow is required to introduce it into the distributor pipe, and the flow resistance is low.

A channel is expediently recessed in the wall of the housing in which the cold air supply pipe and the distributor pipe run adjacent to each other. If the channel is recessed from the insulating material layer of the back wall a solid inner skin of the housing, which separates the insulating material layer from the cooling zone, can follow the course of the recess, so to delimit the channel from the cooling zone a covering profile that bridges the recess is required.

The channel is preferably only recessed in the insulating material layer and the inner skin bridges the channel.

In this latter case an extruded profile with a back wall and two side walls that touch the inner skin is expediently provided and separates the channel from the insulating material layer and if the insulating material layer is produced by expanding a polymer material to form a foam between inner skin and outer skin of the wall, thus prevents this foam from also penetrating or filling the channel.

So the extruded profile can better withstand the pressure of the expanding foam, at least one web that extends toward the inner skin is formed on its back wall.

A layer, arranged between the inner skin and the cold air supply pipe, of insulating material ensures thermal separation between the air flowing in the cold air supply pipe and the first cooling zone, so the zone is not undesirably also cooled if cold air flows through this pipe to the second cooling zone.

The layer is preferably part of an angle profile, particularly preferably of a U-profile, which also extends between the cold air supply pipe and the distributor pipe to ensure a thermal separation between them as well.

For uniform distribution of the cold air in the first cooling zone it is advantageous if two distributor pipes extend either side of the cold air supply pipe.

The valve for selective supply of cold air to the cold air supply pipe and the cold air supply opening preferably comprises a flap which is articulated to a partition between the two.

Figure 2:
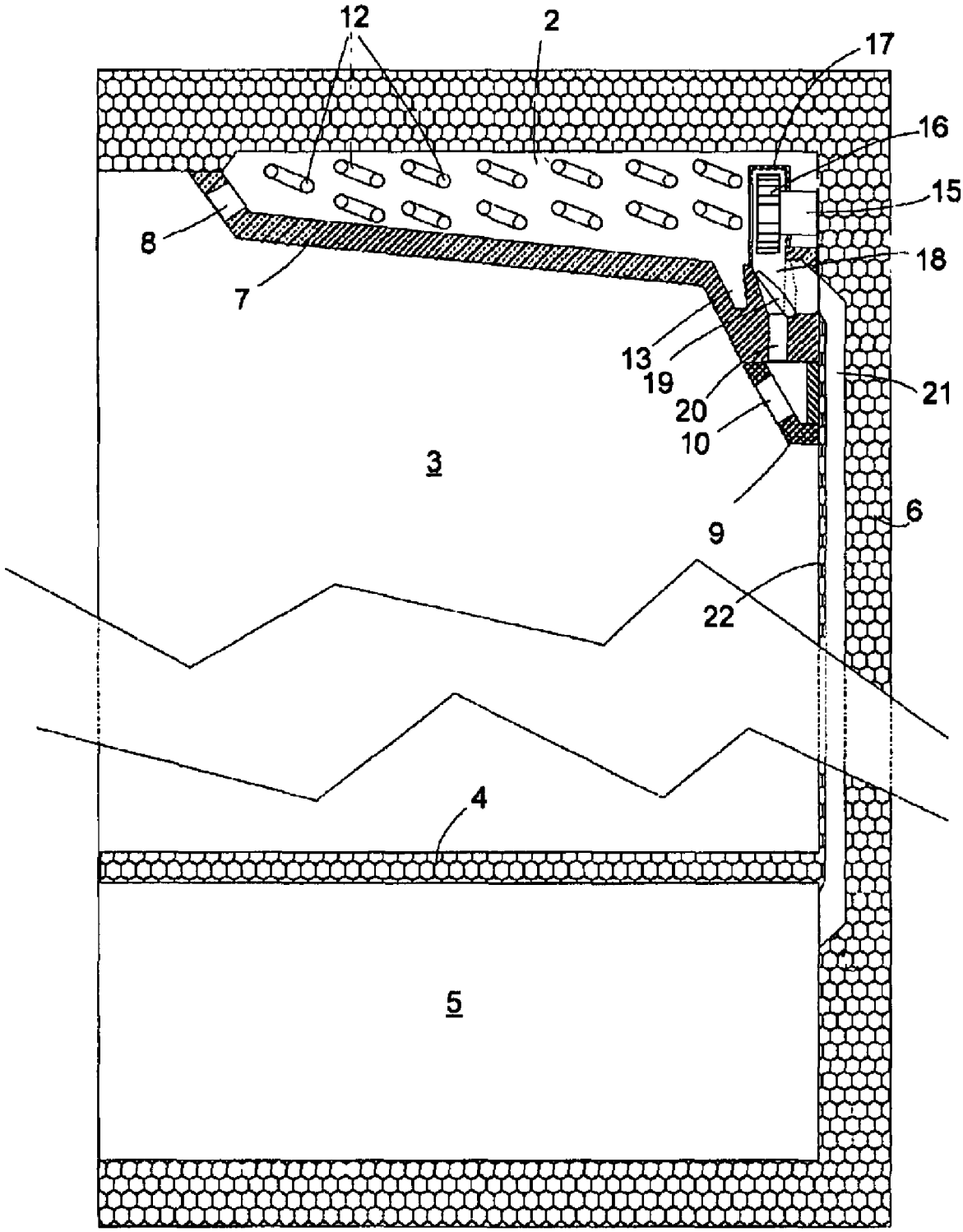
Figure 3:
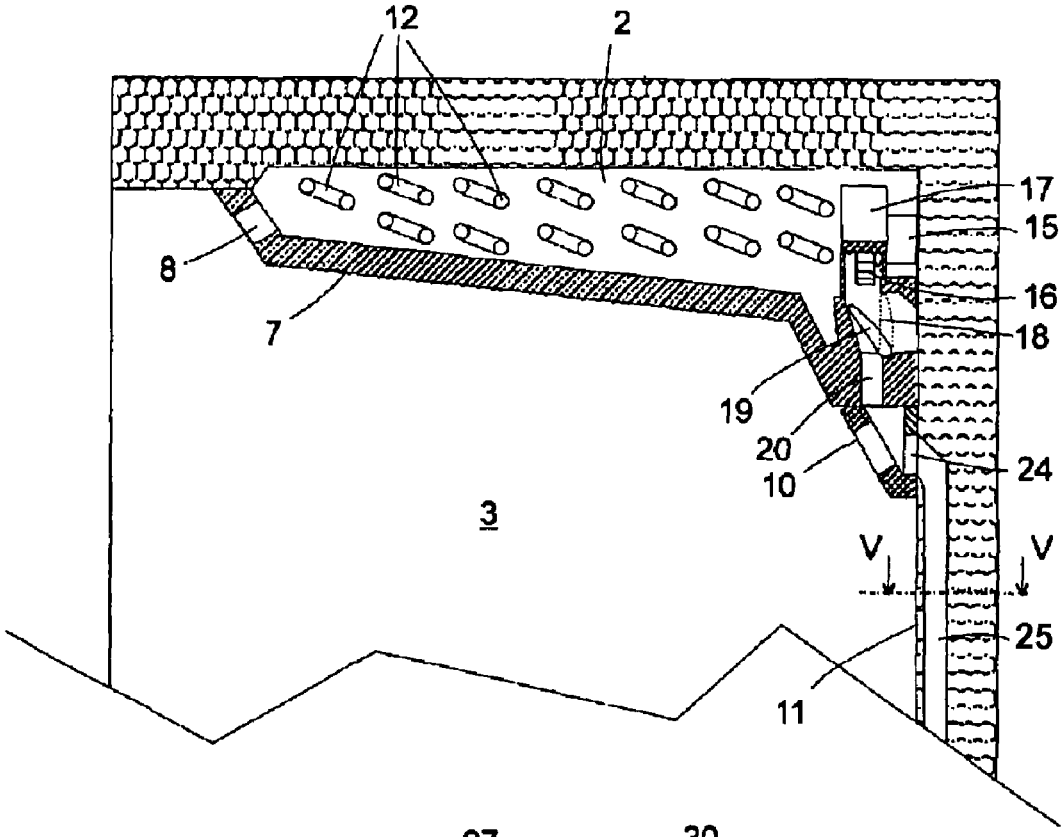
Figure 4:
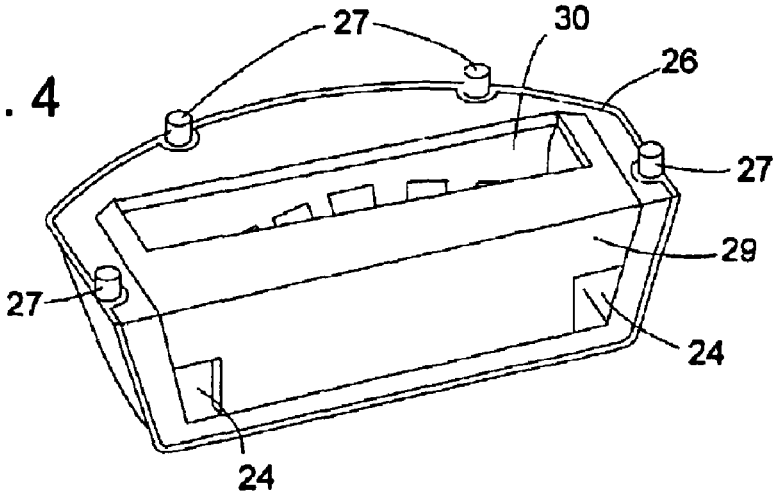
Figure 5:
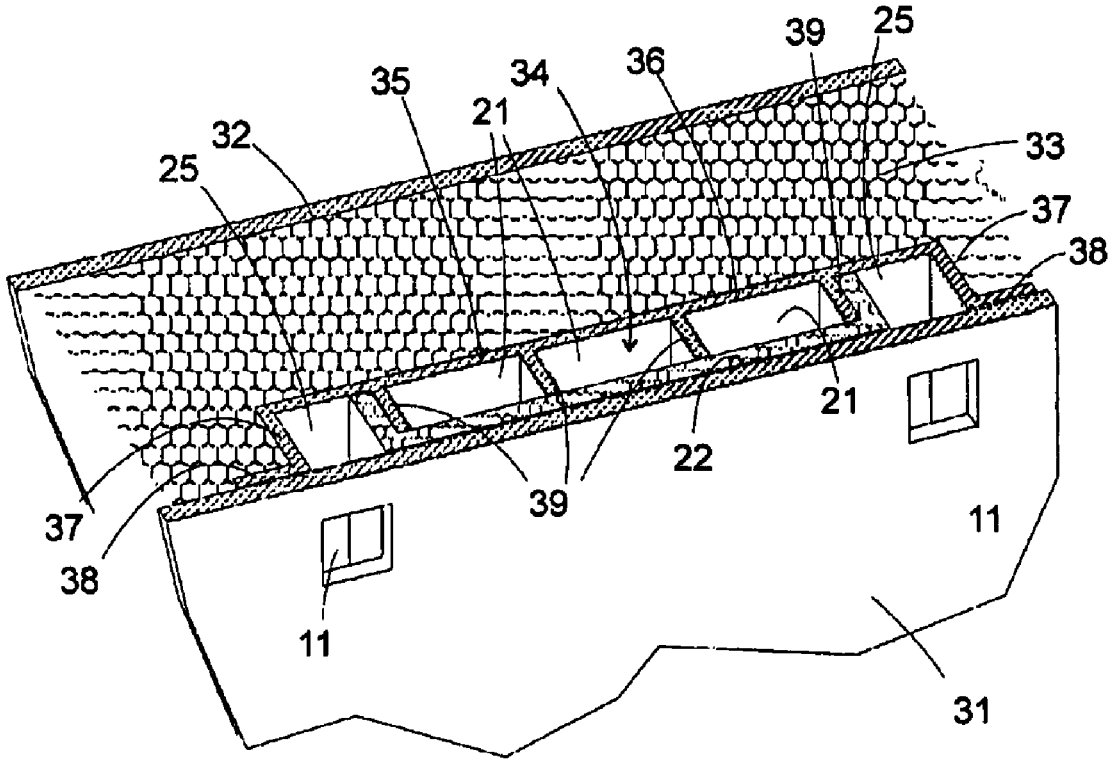

Further features and advantages of the invention emerge from the following description of exemplary embodiments with reference to the accompanying drawings, in which:

FIG. 1 shows a perspective view obliquely from below the body of a refrigerator according to the invention, FIG. 2 shows a section through a vertical central plane of the body, extending in the depth direction, along the line II from FIG. 1, FIG. 3 shows a section through the upper region of the body in a plane offset to the side with respect to the central plane, along the line III from FIG. 1, FIG. 4 shows a perspective view of the hood arranged on the cold air supply opening, and FIG. 5 shows a horizontal partial section through the back wall of the body of the refrigerator.

FIG. 1 shows a perspective view of a body 1 of a refrigerator according to the invention. The appliance has a door, which has been omitted in FIG. 1. The interior of the body 1 is divided into an evaporator zone 2 at the top, below the cover of the body, a first cooling zone 3 and, separated therefrom by an insulating partition 4, a second cooling zone 5. A pull-out box is accommodated in the second cooling zone 5. The first cooling zone 3 is normally divided by a plurality of carriers for goods to be cooled into compartments that are located one above the other but these are omitted in FIG. 1 in order to be able show the back wall 6 of the body 1 over as large an area as possible.

An air inlet port 8, through which air from the first cooling zone 3 can enter the evaporator zone 2, is formed on the front side of a partition 7 that separates the evaporator zone 2 from the first cooling zone 3 (see FIG. 2). Pipes, through which air can flow from the second cooling zone 5 to the evaporator zone 2, can run in side walls of the body 1—not visible in the figure. A further possibility is an air pipe in the interior of the door, which starts at the level of the second cooling zone 5 and ends opposite the air inlet port 8.

Adjacent to the back wall 6 and secured to the partition 7 is a distributor hood 9 on which a large number of air holes 10 is formed, through which cold air originating from the evaporator zone 2 is distributed in various directions in the upper part of the first cooling zone 3. A plurality of pairs of openings 11, from which cold air may also flow, is located below the distributor hood 9 on the back wall 6. The height of these pairs of openings is selected such that if carriers for goods to be cooled are assembled in the first cooling zone 3, each pair of openings 11 supplies one compartment.

FIG. 2 shows the refrigerator of FIG. 1 in a section along a central plane extending vertically and in the depth direction of the body 1, shown in FIG. 1 by a dot-dash line II. Cooling coils of an evaporator 12 can be seen in the section inside the evaporator zone 2. Air that penetrates through the air inlet port 8 flows against the coils. The partition 7 slopes toward the back wall 6 of the body to a channel 13 in which condensation water dripping from the evaporator 12 collects. The condensation water reaches an evaporator, accommodated in the base region 14 (see FIG. 1) of the body 1, via a pipeline (not shown).

Behind the channel 13 and adjacent to the back wall 6 is accommodated a fan which comprises a motor 15, a blade wheel 16 driven thereby, and a housing 17. An intake opening is formed on the front side of the housing 17, in the axial direction of the blade wheel. The upper half of the housing 17 runs in the peripheral direction, closely around the blade wheel 16. At the bottom the housing 17 is open, so a rotation of the blade wheel 16 causes radially outwardly accelerated air to flow downwards into a chamber 18.

A swiveling flap 19 is accommodated in this chamber 18. In the position shown in the figure the flap 19 blocks a cold air supply opening 20, which leads vertically downwards to the first cooling zone 3. The air is thus pushed away toward the back wall 6 and into a cold air supply pipe 21 which inside the back wall, separated from the first cooling zone 3 by a thin insulating layer 22, leads to the second cooling zone 5. If the flap 19 articulated to a partition 23 between the cold air supply opening 20 and the cold air supply pipe 21 is brought into a vertical position, shown in the figure as a dotted outline, it blocks the cold air supply pipe 21 and the cold air flow reaches the distributor hood 9 through the cold air supply opening 20. One of the air holes 10, through which the air flows from the distributor hood 9 into the first cooling zone 3, can be seen in the figure.

FIG. 3 shows a section through the upper part of the body 1, along the plane designated III in FIG. 1. The housing 17 that extends arcuately around the blade wheel 16 can be seen more clearly in this figure. It can also be seen that in this plane the side of the distributor hood 9 that faces the back wall 6 has an opening 24 which aligns with an opening of the back wall 6 that leads to a distributor pipe 25 extending vertically in the back wall 6. One of the plurality of further openings 11 leading from the distributor pipe 25 into the first cooling zone 3 can also be seen.

If the cold air supply opening 20 is open a back pressure results in the interior of the hood 9 from the deflection of air flowing vertically downwards through the opening in an obliquely downward and forward-extending direction to the air holes 10 in the hood 9, the back pressure driving some of the air into the distributor pipe 25. The size of this portion of air can be determined by appropriately fixing the cross-sections of the air holes 10, the openings 11, 24 and the distributor pipe 25.

FIG. 4 shows a perspective view of the distributor hood 9. It comprises a rigid outer skin 26 on which a plurality of pins 27 for latching on the partition 7 are formed, a first layer made of expanded foam 28, which on the inside rests on the outer skin 26 and can be formed in one piece therewith, and a second foamed body 29. On the upper side of the hood 9 the layer 28 and the foamed body 29 form an admission 30 that aligns with the cold air supply opening 20, and on the rear side of the hood 9 that faces the observer, delimited from the layer 29 and the body 29, two openings 24 can be seen which each lead to one of two distributor pipes 25 which extend in the back wall 6 adjacent to the cold air supply pipe 21.

FIG. 5 shows a section through the back wall 6 of the body 1 at the level of the line designated V-V in FIG. 3. The back wall is constructed from a rigid inner skin 31 which, thermoformed from a plastics material board, lines the interior of the body 1 in one piece, an outer skin 32 and a layer 33 made of foamed insulating material. A vertical channel 34 is recessed from the layer 33 and is delimited from the insulating layer 33 by a plastics material extruded profile 35. The extruded profile 35 has a back wall 36, side walls 37 that extend from the edges of the back wall 36 to the inner skin 31, and elongate flanges 38 glued so as to be foam-tight to the inner skin 31 at the edges of the side walls. Ribs 39 that protrude from the back wall 36 each extend up to the insulating layer 22, already mentioned and formed as a flat, U-shaped profile, and are supported thereon against the pressure that acts on expansion of the insulating foam layer 33 toward the rear side of the wall 36. The ribs 39, together with the insulating layer 22, divide the channel 34 into a total of five parallel pipes, of which the two outer ones each form a distributor pipe 25 and the three inner ones constitute the cold air supply pipe 21.

The invention claimed is:

1. A refrigerator comprising:

a.) a housing in which an evaporator zone and a first cooling zone are disposed, the evaporator zone and the first cooling zone being separated from each other;

b.) a heat-insulating partition between the evaporator zone and the first cooling zone;

c.) a central inlet port adjacent to the heat-insulating partition;

d.) a fan for driving a cold air flow from the evaporator zone into the first cooling zone via the central inlet port adjacent to the heat-insulating partition; and e.) an air distributing manifold, the air distributing manifold having an entry channel arranged upstream of the central inlet port in the direction of flow of the cold air, the air distributing manifold operable to receive cold air that has exited the evaporator zone and to divert a partial flow of cold air into at least one wall-extending distributor pipe that extends along at least one wall of the first cooling zone and has wall-distributed openings distributed over the height extent of the wall and communicated with the first cooling zone, whereby the partial flow of cold air that has been diverted by the air distributing manifold flows through the at least one wall-extending distributor pipe and enters into the first cooling zone via selected ones of the wall-distributed openings.

2. The refrigerator as claimed in claim 1, wherein the at least one wall-extending distributor pipe has at least one entry aperture via which air enters the at least one wall-extending distributor pipe, the entry channel of the air distributing manifold is formed in the heat-insulating partition, and the air distributing manifold is formed by a hood that collectively encompasses the entry channel of the air distributing manifold and at least one entry aperture of the wall-extending distributor pipe.

3. The refrigerator as claimed in claim 2, wherein the central inlet port is formed on the hood.

4. The refrigerator as claimed in claim 2 and further comprising a second cooling zone and a deflecting means, the second cooling zone being cooled with cold air supplied via a second cooling zone cold air supply pipe extending in a wall of the housing from the evaporator zone, thereafter past the first cooling zone, and thereafter to the second cooling zone, and the deflecting means being disposed between a blocking position in which it blocks the supply of cold air to the air distributing manifold from the evaporator zone while permitting the supply of cold air to the second cooling zone cold air supply pipe and a clearing position in which it blocks the supply of cold air to the second cooling zone cold air supply pipe while permitting the supply of cold air from the evaporator zone to the air distributing manifold.

5. The refrigerator as claimed in claim 4, wherein the wall-extending distributor pipe extends substantially parallel to the flow direction of the cold air through the entry channel of the air distributing manifold and the flow direction of the cold air through the central inlet port is different than the flow direction of the cold air through the entry channel of the air distributing manifold.

6. The refrigerator as claimed in claim 2 and further comprising a channel formed in a recessed manner in a wall of the housing, the wall-extending distributor pipe and the second cooling zone cold air supply pipe extending adjacent to each other within the channel.

7. The refrigerator as claimed in claim 6, wherein the channel is recessed in an insulating material layer of the wall and an inner skin of the wall extends across a side of the channel.

8. The refrigerator as claimed in claim 7, wherein the channel is separated from the insulating material layer by an extruded profile with a back wall and two side walls that touch the inner skin, and at least one rib that extends up to the inner skin is formed on the back wall.

9. The refrigerator as claimed in claim 7, and further comprising a layer made of insulating material arranged in the channel between the inner skin and the wall-extending distributor pipe.

10. The refrigerator as claimed in claim 9, wherein the layer made of insulating material is part of an angle profile that extends between the cold air supply pipe and the wall-extending distributor pipe.

11. The refrigerator as claimed in claim 9, wherein two of the wall-extending distributor pipes extend each on a respective side of the entry channel of the air distributing manifold.

12. The refrigerator as claimed in claim 4, wherein the deflecting means includes a flap that is capable of moving in an articulated manner to form a partition between the cold air supply pipe and the entry channel of the air distributing manifold.

13. A refrigerator, comprising:

a housing;

an evaporator zone within the housing;

a first cooling zone within the housing and separated from the evaporator zone by a heat-insulating partition, the first cooling zone having a first target temperature;

a second cooling zone within the housing and separated from the first cooling zone, the second cooling zone having a second target temperature that is different from the first target temperature;

a fan for moving cooling air from the evaporator zone to the first and second cooling zones;

a distributor hood adjacent to the heat-insulating partition;

an entry channel located in the heat-insulating partition, the entry channel fluidly connecting the fan to the distributor hood;

a central inlet port located in the distributor hood, the central inlet port fluidly connecting the distributor hood to the first cooling zone;

a distributor pipe located in a wall of the housing;

an entry aperture located in the distributor hood, the entry aperture fluidly connecting the distributor hood to the distributor pipe; and an opening located in the distributor pipe, the opening fluidly connecting the distributor pipe to the first cooling zone, wherein the central inlet port opens directly into the first cooling zone.

14. The refrigerator as claimed in claim 13, further comprising a chamber fluidly connected to the fan upstream from the entry channel;

a cold air supply pipe located in the wall of the housing, the cold air supply pipe being fluidly connected to the chamber and fluidly connected to the second cooling zone.

15. The refrigerator as claimed in claim 14, further comprising a flow diverter located in the chamber for diverting cooling air alternatively into the cold air supply pipe and the entry channel.

16. The refrigerator as claimed in claim 15, wherein the flow diverter is a flap.

17. The refrigerator as claimed in claim 15, further comprising a pipe defining member, the pipe defining member being located behind the wall of the housing and defining at least three walls of the cold air supply pipe and at least three walls of the distribution pipe.

18. The refrigerator as claimed in claim 17, further comprising an insulating angled section, wherein the pipe defining member has a back wall and plurality of ribs protruding from the back wall, the insulating angled section is located between the ribs and the wall of the housing, and the cold air supply pipe and the distributor pipe are defined by the back wall of the pipe defining member, the ribs, the insulating angled section, and the wall of the housing.

19. The refrigerator as claimed in claim 18, wherein a portion of the insulating angled section is located between the cold air supply pipe and the distributor pipe.

20. The refrigerator as claimed in claim 15, wherein the cold air supply pipe comprises multiple cold air supply pipes, and the distributor pipe comprises multiple distributor pipes.

* * * * *